US005513396A

United States Patent [19]

Tsipov

[11] Patent Number: 5,513,396

[45] Date of Patent: May 7, 1996

[54] TOILET BOWL OR BIDET HAVING AN OBSERVATION SCREEN

[76] Inventor: Michael Tsipov, 30-26 Brighton 14th, #C5, Brooklyn, N.Y. 11235

[21] Appl. No.: 368,971

[22] Filed: Jan. 5, 1995

[51] Int. Cl.[6] ..... E03D 11/02

[52] U.S. Cl. ..... 4/420; 4/661

[58] Field of Search ..... 4/314, 420, 661

[56] References Cited

U.S. PATENT DOCUMENTS 4,623,955 11/1986 Santini ..... 4/661 X 5,201,080 4/1993 Tanaka et al. ..... 4/443

FOREIGN PATENT DOCUMENTS 1152364 6/1989 Japan ..... 4/661

*Primary Examiner*—Charles E. Phillips

*Attorney, Agent, or Firm*—Ilya Zborovsky

[57] ABSTRACT

A toilet unit comprises a toilet bowl having a wall limiting an interior and provided with an upper part on which a user can sit, an observation screen located outside of the toilet bowl, and a plurality of light guiding elements extending from the interior of the bowl to the observation screen so that by looking on the observation screen a user can see lower parts of his or her body while sitting on the toilet bowl.

5 Claims, 1 Drawing Sheet

TOILET BOWL OR BIDET HAVING AN OBSERVATION SCREEN

BACKGROUND OF THE INVENTION

The present invention relates to a toilet unit such as toilet bowl or a toilet bidet.

Toilet bowls and bidets are well known and widely utilized. Some of the toilet bowls and bidets are provided with spraying devices, drying devices, etc. It is desirable to monitor for example controlling a position of the spray, controlling drying after spraying. Sometimes medical personnel in order to facilitate some steps in gynecology, obstetrician and hygiene ask patients to perform some procedures during sitting on a toilet bowl or bidet in clinical and home conditions. This can be done accurately and faster only if a person can see his actions while sitting on a toilet bowl or bidet. However, there is no means allowing observation of a toilet bowl or bidet during these actions.

SUMMARY OF THE INVENTION

Accordingly, it is an object of the present invention to provide a toilet unit, such as a toilet bowl or bidet, which avoids the disadvantages of the prior art and allows observation of lower parts of a user's body.

In keeping with these objects and with others which will become apparent hereinafter, one feature of the present invention resides, briefly stated, in a toilet unit, such as a toilet bowl or bidet, which has a screen arranged in an area observable by a person sitting on the unit, and means for supplying an image of a lower part of the user's body from the interior of the toilet unit to the screen.

When the toilet unit is designed in accordance with the present invention, a user sitting on a toilet bowl or on a bidet can observe the lower part of his or her body for performing certain actions.

In accordance with another feature of the present invention, means is provided for turning on the projecting of the image of the lower part of the user's body on the screen which can be used as an on-off switch turnable by the user and an internal illuminating element actuatable by the switch.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 2:
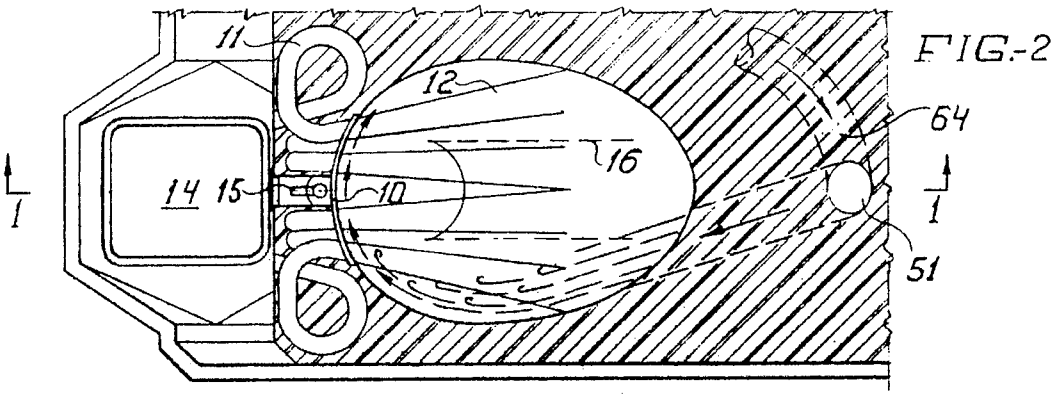
FIG. 2 is a view showing an inclined horizontal section of the toilet unit in accordance with the present invention.

In accordance with the present invention, a front part of an inner surface of a toilet bowl or a bidet bowl is provided with a sheet-like element 10 composed of a transparent material. The element 10 can be molded into the body of the bowl. Optical guides for example optical fibers 11 are connected with their one end to the inner surface of the element 10 in a well known means for providing an optical contact therebetween. The optical guides have such a diameter that its minimal number, uniform distribution and desired direction, they can receive light beams 12 from the whole area underneath a toilet seat or a lower part of a user's body approximately in accordance with a contour of the line O. The optical guides are arranged so that each tapered light guide receives a light image from a desired partial area of the total area to be observed. The light guides extending from the panel 10 are provided with casings and bent so as to thereafter extend through the wall of the bowl toward the lower part. Then the light guides are connected with a known converter 13. The converter converts the light beams into an image to be projected to the screen 14.

As can be seen from the drawings, the screen is arranged in the central lower front part of the bowl. This is convenient for a person sitting on the toilet or bidet and most efficiently uses the space and area of the floor occupied by the bowl. The angle of inclination of the surface of the screen is selected so that the surface is perpendicular to the direction of the observation L of a person sitting on the bowl with the head lowered. In addition, the screen can be designed so that it can magnify the image, or for purpose it can be designed as a magnifying screen or provided with an additional magnifying element.

A cartridge 15 with a bulb and a reflector for reflecting the lower part of the body through the transparent element 10 is arranged in the center of the front part of the bowl. In order to withdraw heat during the use of incandescent bulb, a louver grate 15' closes a recess from the front and allows air circulation.

Figure 3:
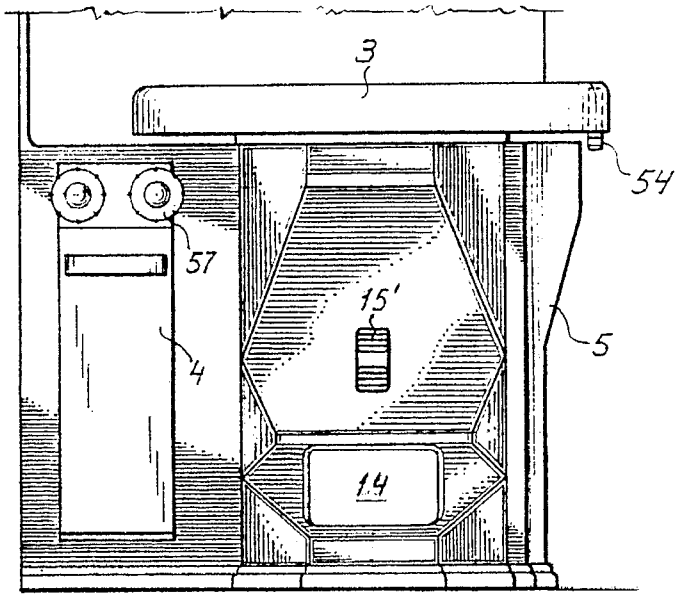
FIG. 3 is a front view of a toilet unit in accordance with the present invention.
Figure 1:
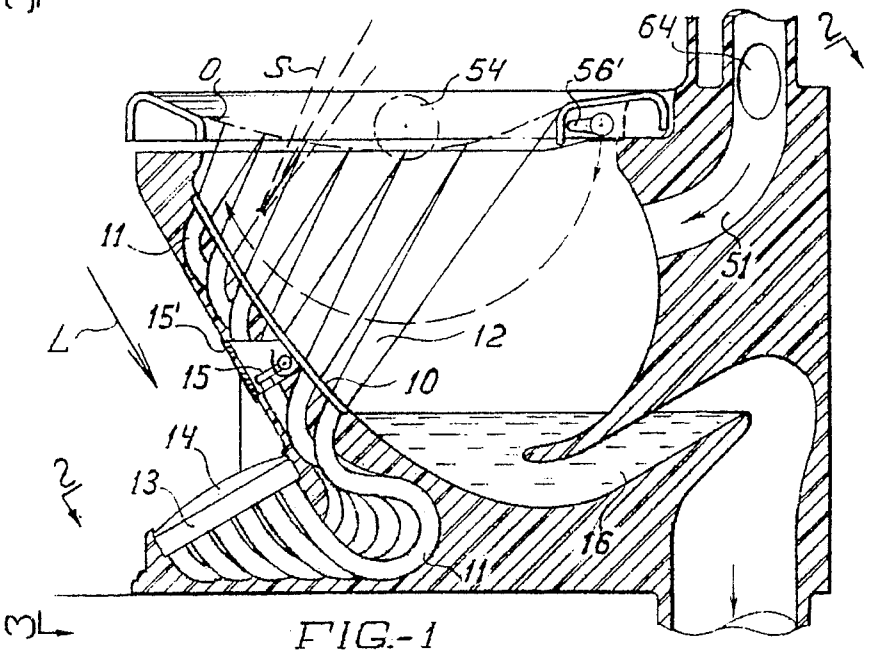
FIG. 1 is a view showing a vertical section of a toilet unit in accordance with the present invention.

A pipe 51 extends into the unit from above for supplying water for washing a bowl and air for drying after the use of spraying. Air is heated in a unit 4 and supplied from the side through a pipe 64 as shown for example in FIGS. 1, 2, 3; and 11, 12 of U.S. Pat. No. 5,253,373 and FIGS. 1, 5, 3, 17 of patent application Ser. No. 08/273,450. An outlet opening into the bowl is formed so that the stream enters along a tangent to the lower surface of the bowl as shown in FIG. 2. A drainage through a syphoning hydroclosure 16 to a draining system is arranged in the lower part of the bowl. A spray cartridge 56' is located in the lower part under the seat and the direction of spraying is illustrated, wherein a handle of spray control is identified as 54, and one of the spraying positions is identified as S. See FIG. 1.

In order to operate the device in accordance with the present invention, the handle 57 on the unit 4 is turned by a user clockwise. In a first position of the handle, the handle turns on the supply air for drying. In the second position of the handle, the drying and the display are turned on. In the third position of the handle, only the display is turned on. Simultaneously, the bulb is lit and the image appears on the screen.

When the display is turned on during the use of liquid in the toilet bowl, drops of water can be on the surface of the panel 10 and they can distort the image to be transmitted. In order to eliminate this, the drying air supply is turned on as well. The stream of air supplied into the bowl flows along the inner surface of the bowl, reaches the surface of the panel 10, and blows off water drops from it so as to dry the panel and to maintain a stable image on the screen.

It will be understood that each of the elements described above, or two or more together, may also find a useful application in other types of constructions differing from the types described above.

While the invention has been illustrated and described as embodied in a toilet bowl or bidet, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A toilet unit, comprising a toilet bowl having a wall defining an interior surface, said bowl being provided with an upper part on which a user can sit; an observation screen located outside of said toilet bowl; and a plurality of light guiding elements extending from said wall of said bowl to said observation screen so that by looking on said observation screen a user can see light images transmitted thereto by said light guiding elements, of lower parts of his or her body while sitting on said toilet bowl.

2. A toilet unit as defined in claim 1; and further comprising a transparent element arranged on the inner surface of said wall of said toilet bowl and having one surface facing said interior of said bowl and an opposite surface, said light guiding elements extending from said opposite surface of said transparent element.

3. A toilet unit as defined in claim 2; and further comprising means for illuminating said transparent element and including a light source and means for turning said light source on and off.

4. A toilet unit as defined in claim 3, wherein said turning means includes a switch accessible from outside of said bowl.

5. A toilet unit as defined in claim 2; and further comprising means for removing droplets from said inner surface of said transparent element and including drying air supply means.

* * * * *